US007414405B2

(12) United States Patent
Moore

(10) Patent No.: US 7,414,405 B2
(45) Date of Patent: Aug. 19, 2008

(54) MEASUREMENT TOOL FOR OBTAINING TOOL FACE ON A ROTATING DRILL COLLAR

(75) Inventor: Robert A Moore, Katy, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 396 days.

(21) Appl. No.: 11/195,287

(22) Filed: Aug. 2, 2005

(65) Prior Publication Data

US 2007/0030007 A1 Feb. 8, 2007

(51) Int. Cl.

| | |
|---|---|
| ***G01V 3/00*** | (2006.01) |
| ***G01V 1/40*** | (2006.01) |
| ***G01V 1/00*** | (2006.01) |
| ***E21B 47/022*** | (2006.01) |

(52) U.S. Cl. ..... 324/338; 324/346; 33/313; 702/6; 367/25

(58) Field of Classification Search ..... 324/333, 324/338–343, 346, 351, 355, 356, 368, 369; 340/854.3, 854.4, 855.8; 367/82, 25; 702/6, 702/7, 8, 11, 12, 13; 33/304, 310, 313
See application file for complete search history.

(56) References Cited

U.S. PATENT DOCUMENTS

| | | | |
|---|---|---|---|
| 3,305,771 | A | 2/1967 | Arps |
| 3,377,549 | A | 4/1968 | Newman et al. |
| 3,408,561 | A | 10/1968 | Redwine et al. |
| 4,468,623 | A | 8/1984 | Gianzero et al. |
| 4,652,829 | A | 3/1987 | Safinya |
| 4,720,681 | A | 1/1988 | Sinclair |
| 4,786,874 | A | 11/1988 | Grosso et al. |
| 4,845,433 | A | 7/1989 | Kleinberg et al. |
| 4,873,488 | A | 10/1989 | Barber et al. |
| 4,940,943 | A | 7/1990 | Bartel et al. |
| 5,023,450 | A | 6/1991 | Gold |
| 5,045,795 | A | 9/1991 | Gianzero et al. |
| 5,200,705 | A | 4/1993 | Clark et al. |
| 5,233,522 | A | 8/1993 | Sinclair |
| 5,235,285 | A | 8/1993 | Clark et al. |
| 5,260,662 | A | 11/1993 | Rorden |
| 5,291,137 | A | 3/1994 | Freedman |
| 5,331,331 | A | 7/1994 | Wu |
| 5,339,036 | A | 8/1994 | Clark et al. |
| 5,339,037 | A | 8/1994 | Bonner et al. |
| 5,357,797 | A | 10/1994 | Maki, Jr. et al. |
| 5,359,324 | A | 10/1994 | Clark et al. |
| 5,381,092 | A | 1/1995 | Freedman |
| 5,453,693 | A | 9/1995 | Sinclair et al. |

(Continued)

FOREIGN PATENT DOCUMENTS

| | | | |
|---|---|---|---|
| GB | 2411729 | A | 9/2005 |

(Continued)

*Primary Examiner*—Patrick Assouad
*Assistant Examiner*—David M. Schindler

(57) ABSTRACT

An apparatus for obtaining tool face angles on a rotating drill collar in substantially real time is disclosed. In one exemplary embodiment the apparatus includes a magnetoresistive magnetic field sensor deployed in a tool body. The apparatus further includes a programmed processor configured to calculate tool face angles in substantially real time from the magnetic field measurements. The programmed processor may optionally further be configured to correlate the calculated tool face angles with logging while drilling measurements for use in borehole imaging applications.

32 Claims, 3 Drawing Sheets

U.S. PATENT DOCUMENTS 5,463,319 A 10/1995 Chesnutt et al.
5,463,320 A 10/1995 Bonner et al.
5,467,832 A 11/1995 Orban et al.
5,473,158 A 12/1995 Holenka et al.
5,486,695 A 1/1996 Schultz et al.
5,491,488 A 2/1996 Wu
5,519,318 A 5/1996 Koerner et al.
5,519,668 A 5/1996 Montaron
5,530,358 A 6/1996 Wisler et al.
5,563,512 A 10/1996 Mumby
5,591,967 A 1/1997 Moake
5,661,402 A 8/1997 Chesnutt et al.
5,675,488 A 10/1997 McElhinney
5,850,624 A 12/1998 Gard et al.
5,867,806 A 2/1999 Strickland et al.
5,892,460 A 4/1999 Jerabek et al.
5,899,958 A 5/1999 Dowell et al.
5,953,683 A 9/1999 Hansen et al.
5,966,013 A 10/1999 Hagiwara
6,023,168 A 2/2000 Minerbo
6,037,776 A 3/2000 McGlone
6,064,210 A 5/2000 Sinclair
6,100,696 A 8/2000 Sinclair
6,131,694 A 10/2000 Robbins et al.
6,166,539 A 12/2000 Dahlberg et al.
6,167,348 A 12/2000 Cannon
6,191,586 B1 2/2001 Bittar
6,191,588 B1 2/2001 Chen
6,211,678 B1 4/2001 Hagiwara
6,216,090 B1 4/2001 Hagiwara
6,218,842 B1 4/2001 Bittar et al.
6,272,232 B1 8/2001 Delhomme et al.
6,297,631 B1 10/2001 Ozue et al.
6,304,082 B1 * 10/2001 Gualtieri et al. ..... 324/252
6,321,456 B1 11/2001 McElhinnney
6,359,438 B1 3/2002 Bittar
6,373,254 B1 4/2002 Dion et al.
6,377,050 B1 4/2002 Chemali et al.
6,405,136 B1 6/2002 Li et al.
6,480,000 B1 11/2002 Kong et al.
6,509,738 B1 1/2003 Minerbo et al.
6,518,756 B1 2/2003 Morys et al.
6,523,271 B2 2/2003 Kato
6,531,868 B2 3/2003 Prammer
6,534,986 B2 3/2003 Nichols
6,536,123 B2 3/2003 Tamura
6,539,639 B2 4/2003 Smith
6,541,979 B2 4/2003 Omeragic
6,543,146 B2 4/2003 Smith et al.
6,556,014 B1 4/2003 Kong et al.
6,573,722 B2 6/2003 Rosthal et al.
6,600,321 B2 7/2003 Evans
6,624,634 B2 9/2003 Rosthal et al.
6,625,517 B1 9/2003 Bogdanov et al.
6,633,164 B2 10/2003 Vinegar et al.
6,633,236 B2 10/2003 Vinegar et al.
6,633,816 B2 10/2003 Shirasaka et al.
6,642,714 B2 11/2003 Kobayashi et al.
6,646,441 B2 11/2003 Thompson et al.
6,651,496 B2 11/2003 Van Steenwyk et al.
6,662,875 B2 12/2003 Bass et al.
6,679,332 B2 1/2004 Vinegar et al.
6,680,613 B2 1/2004 Rosthal et al.
6,684,952 B2 2/2004 Brockman et al.
6,693,430 B2 2/2004 Rosthal et al.
6,704,436 B1 3/2004 Anxionnaz et al.
6,710,601 B2 3/2004 Rosthal et al.
6,714,014 B2 3/2004 Evans et al.
6,715,550 B2 4/2004 Vinegar et al.
6,717,404 B2 4/2004 Prammer
6,724,192 B1 4/2004 McGlone
6,747,569 B2 6/2004 Hill et al.
6,758,277 B2 7/2004 Vinegar et al.
6,768,957 B2 7/2004 Kato
6,774,628 B2 8/2004 Ganesan
6,816,788 B2 11/2004 Van Steenwyk et al.
6,826,842 B2 12/2004 Abe et al.
6,833,706 B2 12/2004 Niina
6,843,318 B2 1/2005 Yarbro
2002/0105332 A1 8/2002 Rosthal et al.
2003/0042016 A1 3/2003 Vinegar et al.
2003/0048697 A1 3/2003 Hirsch et al.
2003/0066671 A1 * 4/2003 Vinegar et al. ..... 174/47
2003/0146751 A1 8/2003 Rosthal et al.
2003/0146753 A1 8/2003 Rosthal et al.
2003/0155924 A1 8/2003 Rosthal et al.
2003/0184299 A1 10/2003 Strack
2003/0184303 A1 10/2003 Homan et al.
2003/0227393 A1 12/2003 Vinegar et al.
2004/0079524 A1 4/2004 Bass et al.
2004/0079526 A1 4/2004 Cairns et al.
2004/0144530 A1 7/2004 Bass et al.
2004/0200083 A1 * 10/2004 Yarbro ..... 33/304
2004/0222019 A1 11/2004 Estes et al.
2005/0189947 A1 9/2005 Haugland

FOREIGN PATENT DOCUMENTS

GB 2415049 A 12/2005
GB 2416038 A 1/2006

* cited by examiner

MEASUREMENT TOOL FOR OBTAINING TOOL FACE ON A ROTATING DRILL COLLAR

FIELD OF THE INVENTION

The present invention relates generally to an apparatus for logging a subterranean borehole. More specifically, this invention relates to a measurement tool for making substantially real time tool face angle measurements on a rotating drill collar. By linking such measurements to contemporaneously obtained real time measurements of certain formation properties, the azimuthal variation of the measured property may be determined. In this manner, an image of the measured property within the borehole may be developed. The present invention, therefore, relates specifically to a tool and method for obtaining and processing the real time tool face angle measurements required for borehole imaging applications.

BACKGROUND OF THE INVENTION

Wireline and logging while drilling (LWD) tools measure physical properties of the formations through which a borehole traverses. Such logging techniques include, for example, natural gamma ray, spectral density, neutron density, inductive and galvanic resistivity, acoustic velocity, acoustic calliper, downhole pressure, and the like. Formations having recoverable hydrocarbons typically include certain well-known physical properties, for example, resistivity, porosity (density), and acoustic velocity values in a certain range. In some logging applications it is desirable to determine the azimuthal variation of particular formation properties (i.e., the extent to which such properties vary about the circumference of the borehole). Such information may be utilized, for example, to locate faults and dips that may occur in the various layers that make up the strata. Tools capable of producing azimuthally sensitive information on formation properties are typically identified as imaging tools.

Downhole imaging tools have been available in wireline form for some time. Such wireline tools typically create images by sending large quantities of circumferentially sensitive logging data uphole via a high-speed data link (e.g., a cable). Further, such wireline tools are typically stabilized and centralized in the borehole and include multiple (often times one hundred or more) sensors (e.g., resistivity sensors) extending outward from the tool into contact (or near contact) with the borehole wall. It will be appreciated by those of ordinary skill in the art that such wireline arrangements are not suitable for typical LWD applications. In particular, communication bandwidth with the surface would typically be insufficient during LWD operations (e.g., via known telemetry techniques) to carry large amounts of image-related data. Further, LWD tools are generally not centralized or stabilized during operation and thus require more rugged sensor arrangements.

Several attempts have been made to develop LWD tools and methods that may be used to provide images of various circumferentially sensitive sensor measurements related to borehole and/or formation properties. Many such attempts have made use of the rotation of the BHA (and therefore the LWD sensors) during drilling of the borehole. For example, Holenka et al., in U.S. Pat. No. 5,473,158, discloses a method in which sensor data (e.g., neutron count rate) is grouped by quadrant about the circumference of the borehole. Kurkoski, in U.S. Pat. No. 6,584,837, and Spross, in U.S. Pat. No. 6,619,395, disclose similar methods.

In prior art methods, conventional flux gate magnetometers are utilized to determine the tool face angle of the LWD sensor (which, as described in more detail below, is often referred to in the art as sensor azimuth) at the time a particular measurement or group of measurements are obtained by the sensor. While flux gate magnetometers (also referred to in the art as ring core magnetometers) can be used in borehole surveying applications, such magnetometers have some characteristics that are not ideally suited to imaging applications. For example, flux gate magnetometers typically have a relatively limited bandwidth (e.g., about 5 Hz). Increasing the bandwidth requires increased power to increase the excitation frequency at which magnetic material is saturated and unsaturated. In LWD applications, electrical power is often supplied by batteries, making such power a somewhat scarce resource. For this reason, increasing the bandwidth of flux gate magnetometers beyond about 5 Hz is not practical in many LWD applications. Flux gate magnetometers, therefore, are not well suited for making substantially real-time tool face angle measurements in many LWD settings. There exists a need for sensors and/or sensor arrangements that are suitable for making such real time tool face angle measurements.

Flux gate magnetometers are sensitive instruments requiring careful calibration and handling. Though magnetometers have been used in many LWD and MWD tools, these instruments present design challenges that add to the complexity and expense of the tools. The magnetometers are also relatively expensive, which further compounds this problem. A need exists, therefore, for a more simple, more rugged, and lower cost means for providing substantially real-time azimuthal information in LWD imaging applications.

Moreover, AC and/or DC power is often routed through a drill collar (e.g., from a turbine or a battery pack) to an LWD sensor. The magnetic field about the electrical transmission line is known to interfere with nearby magnetometers. While AC fields may be filtered in certain applications, DC fields are particularly difficult to accommodate. There also exists a need for an arrangement suitable for routing electrical power past magnetic field sensors deployed on a drill collar.

SUMMARY OF THE INVENTION

The present invention addresses one or more of the above-described drawbacks in prior art apparatuses used to measure tool face angles on a rotating drill collar. Exemplary embodiments of this invention include a measurement tool having a tri-axial arrangement of magnetoresistive magnetic field sensors deployed therein. The magnetoresistive sensors are configured to make substantially real time magnetic field measurements (e.g., at 10 millisecond intervals). Embodiments of the tool further include a programmed processor configured to calculate tool face angles from the magnetic field measurements. The processor may be further configured to correlate the calculated tool face angles with contemporaneously obtained logging while drilling data for use in constructing a borehole image of a formation property.

Exemplary embodiments of the present invention may advantageously provide several technical advantages. For example, embodiments of this invention advantageously enable tool face angles to be measured in substantially real time on a rotating drill collar. As such, embodiments of this invention may be utilized in conjunction with circumferentially sensitive LWD tools to form borehole images having improved circumferential sensitivity. Embodiments of the present invention also provide a less expensive and potentially more rugged means of obtaining real-time tool face angle information. Moreover, in exemplary embodiments of this invention, the magnetic field sensors are deployed to advantageously minimize or even substantially eliminate magnetic interference due to the transmission of electrical power through the tool, thereby improving the accuracy of the calculated tool face angles.

In one aspect the present invention includes a borehole imaging tool. The tool includes a tool body configured for rotating with a drill string in a subterranean borehole and at least one magnetoresistive magnetic field sensor deployed in the tool body. The magnetoresistive sensor is disposed to measure first and second cross axial components of a magnetic field in the subterranean borehole. The tool further includes a programmed processor communicatively coupled with the at least one magnetoresistive magnetic field sensor. The programmed processor is configured to (i) calculate tool face angles in substantially real time from the cross axial components of the magnetic field, (ii) receive logging while drilling data from a logging while drilling sensor, and (iii) correlate the logging while drilling data and the tool face angles into a set of corresponding data pairs for use in constructing a borehole image of a formation property.

In another aspect, this invention includes a borehole imaging. The tool includes a tool body configured for rotating with a drill string in a subterranean borehole, at least one magnetoresistive magnetic field sensor deployed in the tool body, and at least one logging while drilling sensor deployed in the tool body. The magnetoresistive sensor is disposed to measure first and second cross axial components of a magnetic field in the subterranean borehole, while the logging while drilling sensor is disposed to make formation property measurements in the subterranean borehole. The tool further includes a programmed processor communicatively coupled with the at least one magnetoresistive magnetic field sensor and the at least one logging while drilling sensor. The programmed processor is configured to calculate tool face angles of the at least one logging while drilling sensor in substantially real time from the cross axial components of the magnetic field.

In a further aspect, this invention includes a downhole measurement tool. The measurement tool includes a tool body configured to be operatively coupled with a drill string and deployed in a subterranean borehole. The measurement tool further includes an electrical transmission path for conducting electrical power from one longitudinal end of the tool to another longitudinal end thereof. The transmission path includes an electrically conductive, non-magnetic tube, deployed in the tool body. At least one magnetic field sensor is deployed in the conductive tube.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
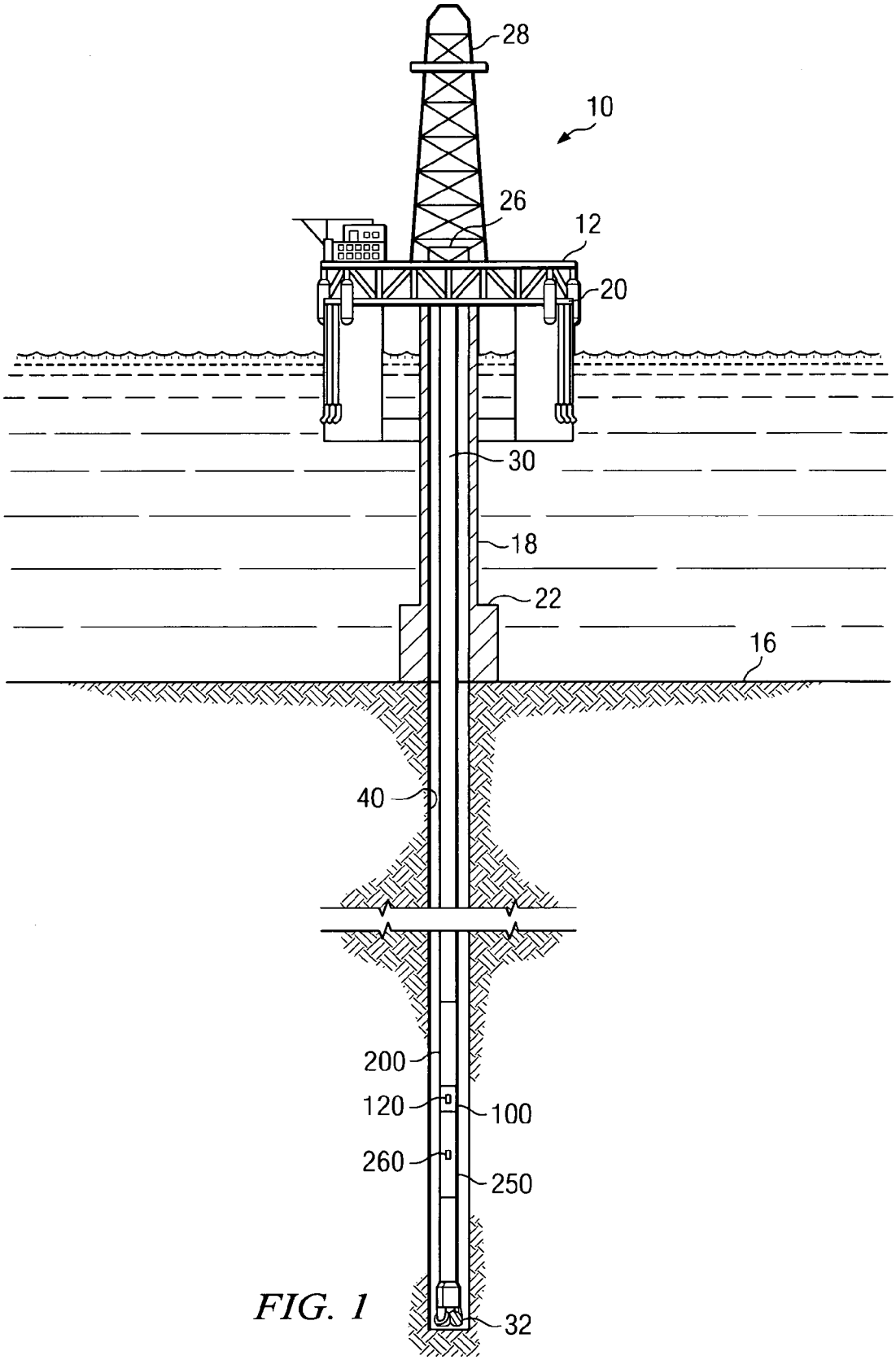
FIG. 1 is a schematic representation of an offshore oil and/or gas drilling platform utilizing an exemplary embodiment of a downhole measurement tool according to the present invention.

Before proceeding with a discussion of the present invention, it is necessary to make clear what is meant by "azimuth" as used herein. The term azimuth has been used in the downhole drilling art in two contexts, with a somewhat different meaning in each context. In a general sense, an azimuth angle is a horizontal angle from a fixed reference position. Mariners performing celestial navigation used the term, and it is this use that apparently forms the basis for the generally understood meaning of the term azimuth. In celestial navigation, a particular celestial object is selected and then a vertical circle, with the mariner at its center, is constructed such that the circle passes through the celestial object. The angular distance from a reference point (usually magnetic north) to the point at which the vertical circle intersects the horizon is the azimuth. As a matter of practice, the azimuth angle was usually measured in the clockwise direction.

In this traditional meaning of azimuth, the reference plane is the horizontal plane tangent to the earth's surface at the point from which the celestial observation is made. In other words, the mariner's location forms the point of contact between the horizontal azimuthal reference plane and the surface of the earth. This context can be easily extended to a downhole drilling application. A borehole azimuth in the downhole drilling context is the relative bearing direction of the borehole at any particular point in a horizontal reference frame. Just as a vertical circle was drawn through the celestial object in the traditional azimuth calculation, a vertical circle may also be drawn in the downhole drilling context with the point of interest within the borehole being the center of the circle and the tangent to the borehole at the point of interest being the radius of the circle. The angular distance from the point at which this circle intersects the horizontal reference plane and the fixed reference point (e.g., magnetic north) is referred to as the borehole azimuth. And just as in the celestial navigation context, the azimuth angle is typically measured in a clockwise direction.

It is this meaning of "azimuth" that is used to define the course of a drilling path. The borehole inclination is also used in this context to define a three-dimensional bearing direction of a point of interest within the borehole. Inclination is the angular separation between a tangent to the borehole at the point of interest and vertical. The azimuth and inclination values are typically used in drilling applications to identify bearing direction at various points along the length of the borehole. A set of discrete inclination and azimuth measurements along the length of the borehole is further commonly utilized to assemble a well survey (e.g., using the minimum curvature assumption). Such a survey describes the three-dimensional location of the borehole in a subterranean formation.

A somewhat different meaning of "azimuth" is found in some borehole imaging art. In this context, the azimuthal reference plane is not necessarily horizontal (indeed, it seldom is). When a borehole image of a particular formation property is desired at a particular point with the borehole, measurements of the property are taken are points around the circumference of the measurement tool. The azimuthal reference plane in this context is the plane centered at the measurement tool and perpendicular to the longitudinal direction of the borehole at that point. This plane, therefore, is fixed by the particular orientation of the borehole measurement tool at the time the relevant measurements are taken.

An azimuth in this borehole imaging context is the angular separation in the azimuthal reference plane from a reference point to the measurement point. The azimuth is typically measured in the clockwise direction, and the reference point is frequently the high side of the borehole or measurement tool, relative to the earth's gravitational field, though magnetic north may be used as a reference direction in some situations. Though this context is different, and the meaning of azimuth here is somewhat different, this use is consistent with the traditional meaning and use of the term azimuth. If the longitudinal direction of the borehole at the measurement point is equated to the vertical direction in the traditional context, then the determination of an azimuth in the borehole imaging context is essentially the same as the traditional azimuthal determination.

Another important label used in the borehole imaging context is the "tool face angle". When a measurement tool is used to gather azimuthal imaging data, the point of the tool with the measuring sensor is identified as the "face" of the tool. The tool face angle, therefore, is defined as the angular separation from a reference point to the radial direction of the tool face. The assumption here is that data gathered by the measuring sensor will be indicative of properties of the formation along a line or path that extends radially outward from the tool face into the formation. The tool face angle is an azimuth angle, where the measurement line or direction is defined for the position of the tool sensors. In the remainder of this document, the terms azimuth and tool face angle will be used interchangeably, though the tool face angle identifier will be used predominantly.

Turning now to FIG. 1, one exemplary embodiment of a measurement tool 100 in accordance with this invention in use in an offshore oil or gas drilling assembly, generally denoted 10, is schematically illustrated. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a measurement tool 100. In the exemplary embodiment shown, measurement tool 100 is deployed between an electrical power sub 200 and a logging while drilling (LWD) tool 250. Power sub 200 may include, for example, a battery pack or alternatively a turbine for converting the flow of drilling fluid into AC power. In the exemplary embodiment shown, electrical power is transmitted through measurement tool 100 to LWD tool 250 via one or more transmission lines (not shown).

Measurement tool 100 includes at least one magnetic field sensor 120. Measurement tool 100 may also further include one or more accelerometers gyroscopes. As described in more detail below with respect to FIG. 2, magnetic field sensor 120 typically includes at least one magnetoresistive magnetic field sensor deployed on or near the longitudinal axis of measurement tool 100.

LWD tool 250 typically includes at least one LWD sensor 260 deployed thereon. Such LWD sensors may include substantially any downhole logging sensors, for example, including a natural gamma ray sensor, a neutron sensor, a density sensor, a resistivity sensor, a formation pressure sensor, an annular pressure sensor, an ultrasonic sensor, an audio-frequency acoustic sensor, and the like. While the embodiment shown on FIG. 1, includes a measurement tool 100 deployed adjacent to electrical power sub 200 and LWD tool 250, it will be appreciated that the invention is not limited in this regard.

It will be understood by those of ordinary skill in the art that the deployment illustrated on FIG. 1 is merely exemplary for purposes of describing the invention set forth herein. It will be further understood that the measurement tool 100 of the present invention is not limited to use with a semisubmersible platform 12 as illustrated on FIG. 1. Measurement tool 100 is equally well suited for use with any kind of subterranean drilling operation, either offshore or onshore.

Figure 2:
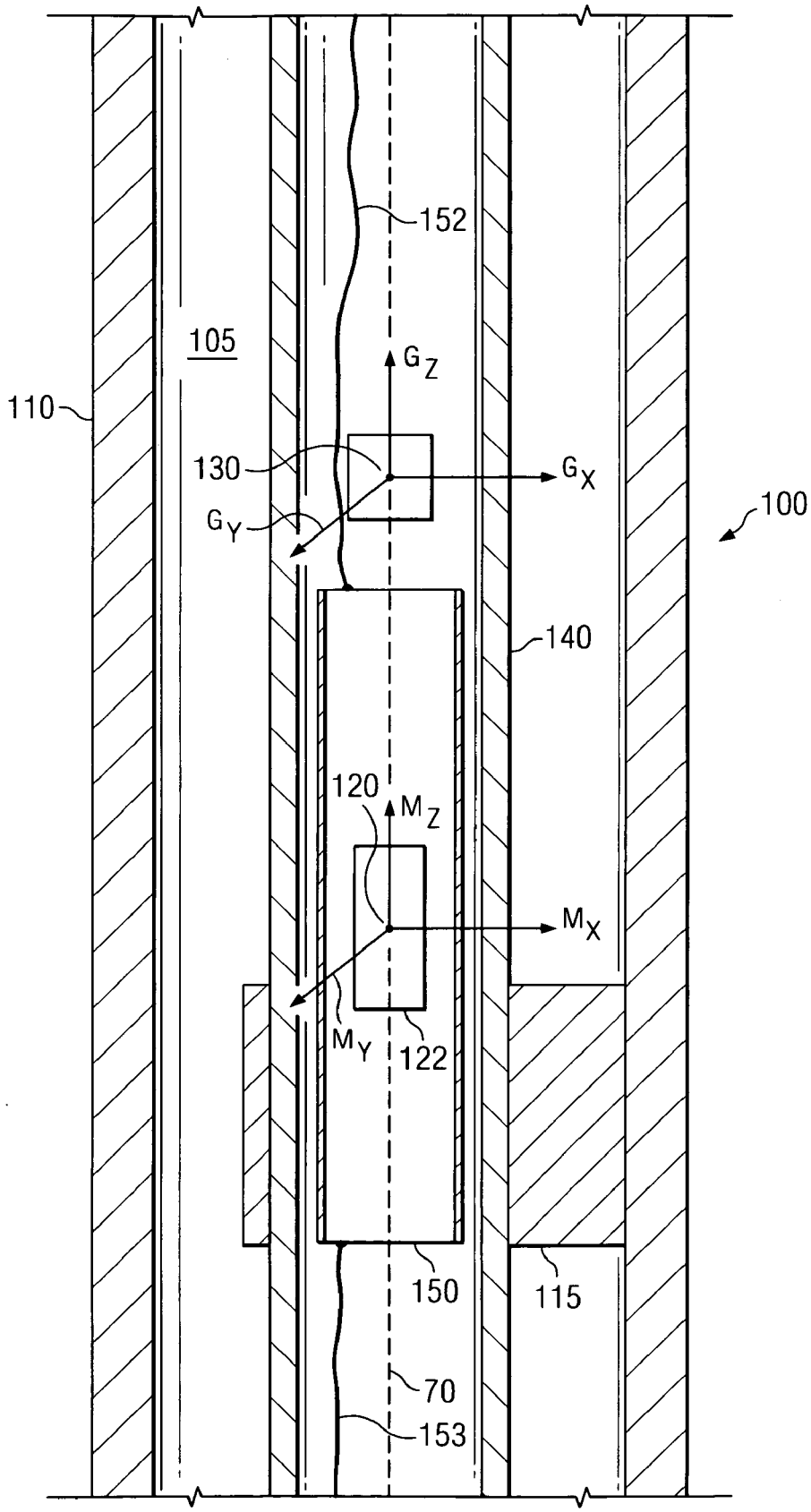
FIG. 2 depicts, in longitudinal cross section, a portion of downhole measurement tool shown on FIG. 1.

Referring now to FIG. 2, a portion of one exemplary embodiment of measurement tool 100 from FIG. 1 is schematically illustrated. Measurement tool 100 is typically a substantially cylindrical tool, being largely symmetrical about longitudinal axis 70. Measurement tool 100 includes a tool body 110 configured for coupling to a drill string (e.g., drill string 30 on FIG. 1) and therefore typically, but not necessarily, includes conventional threaded pin and/or box ends (not shown). Measurement tool 100 further includes a pressure housing 140 deployed substantially coaxially in the tool body 110. The outer diameter of pressure housing 140 is typically less than the inner diameter of tool body 110, thereby providing an annular region 105 for the flow of drilling fluid downhole, for example, to a drill bit assembly (e.g., drill bit 32 on FIG. 1). In the exemplary embodiment shown in FIG. 2, a plurality of stabilizer fins 115 extend radially outward from pressure housing 140 into contact with an inner surface of the tool body 110. The stabilizer fins 115 are intended to stabilize and center the pressure housing 140 substantially coaxially in the tool body 110.

As described above with respect to FIG. 1, electrical power may be routed through measurement tool 100 (e.g., from power sub 200 to LWD tool 250 as shown on FIG. 1). In the exemplary embodiment shown, the electrical power is routed from the power sub 200 through conductor 152, electrically conductive tube 150, and conductor 153 to the LWD tool 250. Tube 150 is deployed substantially coaxially in the pressure housing 140 (although the invention is not limited in this regard) and may be fabricated from substantially any electrically conductive, non magnetic material, such as, but not limited to, copper, copper alloys (e.g., including brass and bronze), aluminum, and aluminum alloys. Measurement tool 100 further includes a magnetic field sensor 120 deployed in the conductive tube 150. Such an arrangement is intended to minimize magnetic interference from the transmission of the electrical current through the measurement tool 100.

It will be appreciated that according to Ampere's law, there is essentially no magnetic field inside a hollow conductor due to electrical current in the conductor. Ampere's law states that the integral of the magnetic field about any closed loop path is equal to the magnetic permeability times the electric current enclosed in the loop. This may be expressed mathematically as follows:

$$\oint \vec{B} d\vec{l} = \mu_0 I_{enclosd} \quad \text{Equation 1}$$

where $\vec{B}$ represents the magnetic field, $\mu_0$ represents the magnetic permeability, and $I_{enclosd}$ represents the electrical current closed in the loop. The cylindrical symmetry of tube 150 requires that the magnetic field $\vec{B}$ is essentially constant about any circle whose center is coaxial with the tube 150. The magnetic field may therefore be removed from the integral yielding:

$$\vec{B} \oint d\vec{l} = \mu_0 I_{enclosd} \quad \text{Equation 2}$$

Since the electrical current enclosed in a circular path just inside the inner wall of the tube 150 is essentially zero ($I_{enclosd}$=0 due to the lack of a conducting medium), the magnetic field due to the electrical current in the tube must also be essentially zero. As such, an electric current passing through the conductive tube 150 (e.g., from power sub 200 to LWD tool 250) creates substantially no magnetic interference inside the tube 150. Therefore, the effect of magnetic interference from electrical currents in the tool may be advantageously minimized (or even substantially eliminated) via deployment of the magnetic field sensors 120 inside the conductive tube 150.

Magnetic field sensor 120 may include substantially any sensor suitable for obtaining tool face angles on a rotating drill collar, such as magnetometers or magneto-resistive sensors (either giant magneto-resistive (GMR) sensors or anisotropic magneto resistive (AMR) sensors may be used). In the exemplary embodiment shown, measurement tool 100 includes a tri-axial arrangement Mx, My, and Mz of GMR sensors deployed in tube 150. Such a tri-axial arrangement, in which one of the sensors has a known orientation relative to longitudinal axis 70 (in the exemplary embodiment shown on FIG. 2 Mz is substantially parallel with longitudinal axis 70), advantageously enables the magnetic field to be resolved into a magnetic field vector (having magnitude and direction components).

With continued reference to FIG. 2, exemplary embodiments of measurement tool 100 may also include a tri-axial arrangement Gx, Gy, and Gz of gravity sensors 130 deployed therein, although the invention is not limited in this regard. In the exemplary embodiment show, the gravity sensors 130 are deployed adjacent electrically conductive tube 150 and substantially on the longitudinal axis 70 of the tool 100. It will be appreciated that gravity sensors 130 may be equivalently deployed in the conducting tube 150 along with the magnetic field sensors 120 or elsewhere in the drill string (e.g., in a MWD tool deployed elsewhere in drill string 30 on FIG. 1).

Figure 3:
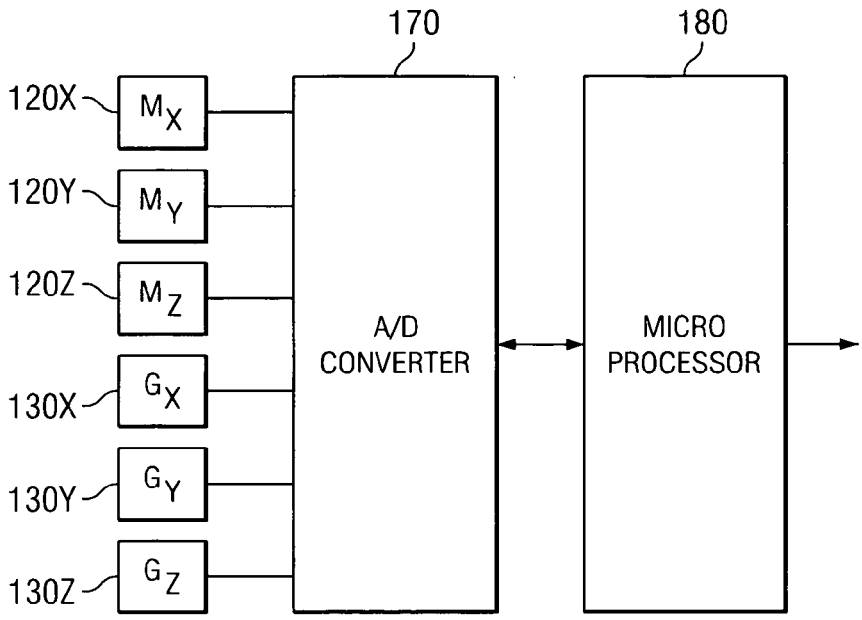
FIG. 3 depicts an exemplary electrical block diagram of a tri-axial arrangement of magnetic field sensors and a tri-axial arrangement of gravity sensors.
Figure 4:
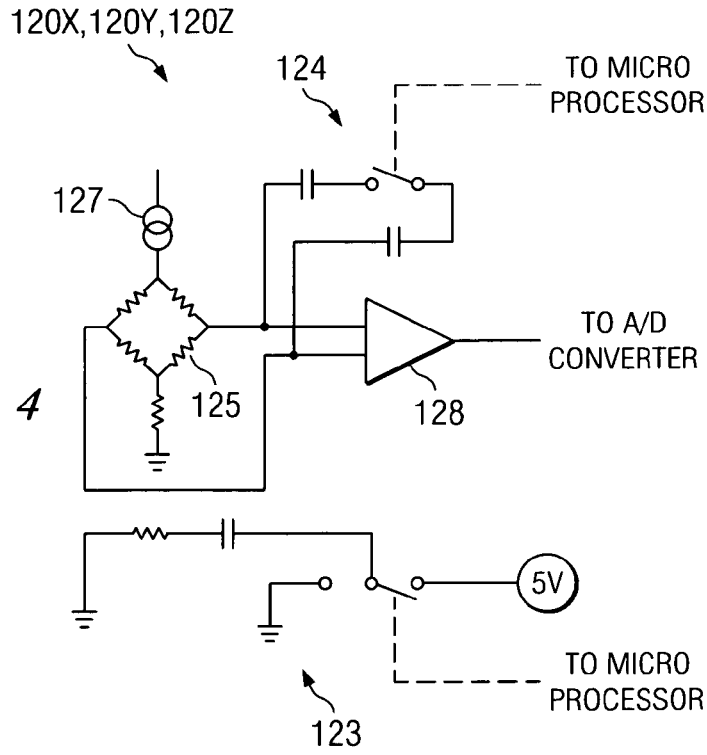
FIG. 4 depicts an exemplary circuit diagram of the tri-axial arrangement of magnetic field sensors shown on FIG. 3.

With reference now to FIGS. 3 and 4, magnetic field sensors 120 and gravity sensors 130 are described in more detail. FIG. 3 illustrates an electrical block diagram of a tri-axial arrangement of magnetic field sensors 120*x*, 120*y*, and 120*z* and a tri-axial arrangement of gravity sensors 130*x*, 130*y*, and 130*z*. In the exemplary embodiment shown on FIG. 3, tri-axial magnetic field sensors 120*x*, 120*y*, and 120*z* are mounted on an electronic circuit board (e.g., as shown schematically at 122 on FIG. 2). The outputs of the magnetic field sensors 120*x*, 120*y*, and 120*z* and gravity sensors 130*x*, 130*y*, and 130*z* are electronically coupled to corresponding inputs of a multi-channel analog to digital (A/D) converter 170, which digitizes the analog components of the magnetic field. In one exemplary embodiment, A/D converter 170 includes two 16-bit A/D converters, each including 4 input channels, such as the AD7654 available from Analog Devices, Inc. (Norwood, Mass.). It will be appreciated that the invention is not limited in this regard as substantially any suitable A/D converter may be utilized.

The magnetic field and gravity sensors referred to herein are preferably chosen from among commercially available sensor devices known in the art. Suitable accelerometer packages include, for example, Part Number 979-0273-001 commercially available from Honeywell, and Part Number JA-5H175-1 commercially available from Japan Aviation Electronics Industry, Ltd. (JAE). As described in more detail below, suitable magnetic field sensors include magnetoresistive sensors, for example, Part Number HMC-1021D, available from Honeywell.

In the exemplary embodiment shown, A/D converter 170 is electronically coupled to a microprocessor, for example, via a 16-bit bus. Substantially any suitable microprocessor may be utilized, for example, including an ADSP-2191 M microprocessor, available from Analog Devices, Inc. It will be understood that while not shown in FIGS. 1 through 4, embodiments of this invention may include an electronic controller. Such a controller may include, for example, microprocessor 180 and A/D converter 170, along with volatile or non-volatile memory, and/or a data storage device. The controller may also include processor-readable or computer-readable program code embodying logic, including instructions for continuously computing tool face angles in substantially real time during rotation of measurement tool 100 in a borehole. Such instructions may include, for example, the algorithms set forth below. The controller may further include instructions for computing borehole inclination and azimuth from gravity and magnetic field measurements. In such exemplary embodiments, measurement tool 100 essentially functions as a measurement while drilling survey tool. Moreover, the controller may include a number of look-up tables for solving the trigonometric functions employed in such algorithms.

A suitable controller may also optionally include other controllable components, such as sensors, data storage devices, power supplies, timers, and the like. The controller may also be disposed to be in electronic communication with various sensors and/or probes for monitoring physical parameters of the borehole. For example, the controller may be disposed to communicate with LWD tool 250 shown on FIG. 1. In this manner, circumferentially sensitive LWD measurements may be correlated with real time tool face angle measurements. A suitable controller may also optionally communicate with other instruments in the drill string, such as telemetry systems that communicate with the surface. The artisan of ordinary skill will readily recognize that a suitable controller may be deployed substantially anywhere within the measurement tool or at another suitable location in the drill string (e.g., in LWD tool 250).

Turning now to FIG. 4, a schematic circuit diagram of exemplary magnetic field sensors 120*x*, 120*y*, and 120*z* is illustrated. In this configuration, each of the magnetic field sensors 120*x*, 120*y*, 120*z* includes a magnetoresistive bridge 125 mounted, for example on a conventional circuit board (such as circuit board 122 shown on FIG. 2) and coupled to a constant current power source 127. The output signal from each magnetoresistive bridge 125 is amplified via a conventional amplifier circuit 128, the output of which is digitized as described above with respect to FIG. 3.

The magnetoresistive elements are typically made from, a nickel-iron (permalloy) thin film deposited on a silicon wafer and patterned as a resistive strip. In the presence of a magnetic field, a change in the bridge 125 resistance causes a corresponding change in voltage output. The change in the bridge 125 resistance is referred to as the magnetoresistive effect and is directly related to the current flow in the bridge 125 and the magnitude and direction of the magnetic field (the magnetic field vector). Suitable magnetoresistive sensors include, for example, part number HMC-1021D, available from Honeywell (Plymouth, Minn.).

With continued reference to FIG. 4, exemplary embodiments of the magnetoresistive sensor 120*x*, 120*y*, 120*z* include a set reset strap 123. Prior to use the sensors are typically "set" by application of high current pulse to the reset strap 123. The current pulse generates a strong enough magnetic field to align the magnetic domains in the magnetoresistors. This ensures a highly sensitive and repeatable sensor state. A negative current pulse (a pulse in the opposite direction) may be utilized to "reset" the sensor in the opposite direction (align the magnetic domains in the opposite direction).

In one exemplary method embodiment, measurement tool 100 (FIGS. 1 and 2) is coupled to a drill string and rotated in a borehole. The sensors may be "set" prior to measurement of a magnetic field by application of a high current pulse to reset strap 123 as described above. The sensor output is then averaged, for example, for about 5 milliseconds. A reset pulse is then applied (as described above), reversing the magnetic domain alignment of the magnetoresistive element (and consequently the bridge output signal polarity). A second sensor output is then averaged, for example, for an additional 5 milliseconds. The controller (not shown) may then calculate a sum and/or a difference of the two sets of measurements in order to account for the bridge offset. In order to maximize the analog input range of A/D converter 170 in subsequent measurements, an offset nulling voltage may be applied to an input of amplifier 128, as known to those of ordinary skill in the art. In a typical downhole environment, for example, in which the temperature and pressure are subject to continuous change, the bridge offset may be determined as frequently as required (e.g., several times per minute if necessary).

In the exemplary method embodiment described above, a tri-axial set of magnetic field measurements may be obtained, for example, at 10 millisecond intervals. For a drill collar rotating at 200 rpm, tool face angles may be determined 30 times per revolution (i.e., at 12 degree intervals). It will be understood that the invention is expressly not limited in this regard, since magnetic field measurements may be made at substantially any suitable interval, either faster or slower than 10 milliseconds. Magnetoresistive sensors are known to be capable of achieving high frequency magnetic field measurements and are easily capable of obtaining magnetic field measurements at intervals of less than 1 millisecond or even at intervals less than 10 microsecond. It will be appreciated that in practice the advantages high frequency magnetic field measurements (e.g., better tool face resolution) may be offset by the challenge of storing and processing the large data sets generated by such high frequency measurements. Nevertheless, as state above, this invention is not limited to any particular magnetic field measurement frequency or to any particular time intervals.

It will be understood that gravitational and magnetic field measurements may be processed to determine tool face angles using substantially any known mathematical techniques. Such techniques are well established in the art, and may be utilized to calculate the tool face angles in substantially any suitable coordinate system, including, for example, earth, tool, and borehole coordinate systems. Moreover, known techniques may be utilized to transform tool face angles between coordinate systems.

For example only, magnetic tool face angles may be determined in substantially real time relative to a "magnetic high side" of the tool (using the real time magnetic field measurements) as follows:

$$MTF = \arctan\left(\frac{Mx}{My}\right) \qquad \text{Equation 3}$$

where MTF represents the magnetic tool face angle and Mx and My represent the x and y components (also referred to as the cross axial components) of the measured magnetic field. As described above, the magnetic tool face angle may be acquired substantially continuously in real time (e.g., at 10 millisecond intervals) while the measurement tool is rotated in the borehole, for example, during drilling. The artisan of ordinary skill in the art will readily be able to transform the magnetic tool face angles determined in Equation 3 to more conventional borehole coordinates (e.g., in which the tool face angle is defined relative to the gravitational high side of the borehole), for example, via processing with the local inclination and azimuth of the tool (or borehole).

In a typical drilling operation, an MWD survey is typically taken when the drill bit is off bottom and after a new section of drill pip has been added to the drill string. Such a survey typically includes, among other things, measuring tri-axial components of the gravitational and magnetic fields and using the measurements to calculate tool (borehole) inclination and azimuth. For example, inclination and azimuth may be determined via the following known equations:

$$Inc = \arctan\left(\frac{\sqrt{Gx^2 + Gy^2}}{Gz}\right) \qquad \text{Equation 4}$$

$$Azi = \arctan\left(\frac{(GxMy - GyMx)\sqrt{Gx^2 + Gy^2 + Gz^2}}{Mz(Gx^2 + Gy^2) - Gz(GxMx - GyMy)}\right)$$

where Inc and Azi represent the inclination and azimuth of the measurement tool in the borehole, Gx, Gy, and Gz represent the tri-axial components of the measured gravitational field, and Mx, My, and Mz represent the tri-axial components of the measured magnetic field. As stated above, the inclination and azimuth may be used to transform the magnetic tool face angles into conventional borehole coordinates.

Alternatively, tool face angles may be computed directly using the cross axial components of the gravity and magnetic field measurements. In such embodiments, the magnetic field measurements may be made in substantially real time (as described above), while the gravity measurements are typically made intermittently, for example, at an MWD survey (as described above). One such direct solution is given below in Equation 5:

$$\begin{pmatrix} \cos\phi \\ \sin\phi \end{pmatrix} = \begin{pmatrix} \hat{B}_x & \hat{B}_y \\ \hat{B}_y & -\hat{B}_x \end{pmatrix} \begin{pmatrix} Mx \\ My \end{pmatrix} \qquad \text{Equation 5}$$

where $\phi$ represents the tool face angle in conventional borehole coordinates, Mx and My represent the measured cross axial components of the magnetic field (typically measured in substantially real time as described above), and where $\hat{B}_x$ and $\hat{B}_y$ are functions of the cross axial components of the gravitational and magnetic fields measured during the MWD survey (e.g., as described above).

While the invention is not limited in this regard, tool face angles measured in substantially real time may be advantageously correlated with circumferentially sensitive logging data to form borehole images. Such logging data may be acquired from substantially any suitable logging while drilling tool (e.g., LWD tool 250 shown on FIG. 1). In use in a borehole imaging application, a measurement tool according to this invention (e.g., measurement tool 100 shown on FIGS. 1 and 2) may be rotated with an LWD tool in a drill string. The LWD tool may include, for example, one or more sensors deployed on an outer surface of the tool that are disposed to make substantially continuous measurements of a formation property adjacent the sensor. It will be appreciated that as the tool rotates in the borehole, the azimuth angle of the sensor in the borehole changes with time. The borehole properties may then be correlated with the continuous tool face angle measurements that are made simultaneously with the sensor measurements (i.e., the sensor data may be tagged with a simultaneously measured tool face angle). Such correlated data may then be utilized to construct a borehole image.

In one exemplary embodiment, a continuous LWD sensor response may be averaged at some predetermined sampling interval (e.g., 10 milliseconds). The duration of each sampling interval is preferably significantly less than the period of the tool rotation in the borehole (e.g., the sampling interval may be about 10 milliseconds, as stated above, while the rotational period of the tool may be about 0.5 seconds). The sensor response may include substantially any LWD sensor response, including for example, an AC current in a LWD resistivity tool, gamma ray radiation counts at a gamma ray detector, and acoustic energy at an acoustic sensor. The invention is not limited in this regard. Meanwhile, a tool face sensor (such as magnetic field sensor 120 shown on FIG. 2) continuously measures the tool face angle of the LWD sensor as it rotates in the borehole. The averaged LWD sensor response in each of the sampling intervals may then be tagged with a corresponding tool face angle and saved to memory. The tool face angles are preferably measured at each sampling interval (e.g., at 10 millisecond intervals), or often enough so that the tool face angle of the LWD sensor may be determined for each sampling interval.

Azimuthally sensitive LWD measurements are typically utilized to form a two-dimensional image of the measured borehole property, the two dimensions being the tool face angle in the borehole and the well depth. To form such a two-dimensional image, LWD sensor measurements may be acquired at a plurality of well depths using substantially any suitable procedure. For example, LWD sensor data may be acquired substantially continuously as described above during at least a portion of a drilling operation. The above-described sampling intervals may be further grouped at relatively longer time intervals (e.g., in 10 second intervals) with each group indicative of a single well depth. At a drilling rate of about 60 feet per hour, a 10 second interval represents about a two-inch depth interval. To form a two-dimensional image the sensor data may be tagged with both a measured tool face angle and a well depth. It will be appreciated that this invention is not limited to any particular sampling intervals and/or time periods. Nor is this invention limited by the description of the above exemplary embodiments.

It will be appreciated that certain LWD tools make use of a plurality of LWD sensors deployed about the periphery of the tool. Such embodiments may advantageously enable azimuthally sensitive measurements to be made about the circumference of the borehole without rotation of the drill string. Moreover, when used with a rotating drill string, such embodiments may advantageously provide for redundancy as well as reduced system noise accomplished via averaging the data acquired at the various sensors.

Although the present invention and its advantages have been described in detail, it should be understood that various changes, substitutions and alternations can be made to the embodiments set forth herein without departing from the spirit and scope of the invention as defined by the appended claims.

I claim:

1. A borehole imaging tool comprising:

a tool body configured for rotating with a drill string in a subterranean borehole;

at least one magnetoresistive magnetic field sensor deployed in the tool body, the sensor disposed to measure first and second cross axial components of a magnetic field in the subterranean borehole;

an electrical transmission path for conducting electrical power from one longitudinal end of the tool to another longitudinal end thereof, the transmission path including an electrically conductive, non-magnetic tube, the conductive tube deployed in the tool body, the at least one magnetoresistive magnetic field sensor deployed in the conductive tube; and a programmed processor communicatively coupled with the at least one magnetoresistive magnetic field sensor, the programmed processor configured to (i) calculate tool face angles in substantially real time from the cross axial components of the magnetic field, (ii) receive logging while drilling data from a logging while drilling sensor, and (iii) correlate the logging while drilling data and the tool face angles into a set of corresponding data pairs.

2. The borehole imaging tool of claim 1, wherein the at least one magnetoresistive magnetic field sensor is selected from the group consisting of giant magnetoresistive sensors and anisotropic magnetoresistive sensors.

3. The borehole imaging tool of claim 1, wherein the at least one magnetoresisrive magnetic field sensor comprises a tri-axial arrangement of magnetoresistive magnetic field sensors, one of the tri-axial arrangement of magnetoresistive magnetic field sensors being substantially aligned with a longitudinal axis of the tool body.

4. The borehole imaging tool of claim 1, further comprising a tri-axial arrangement of gravity sensors.

5. The borehole imaging tool of claim 1, wherein the programmed processor is configured to both calculate the tool face angles and correlate the tool face angles with the logging while drilling data at intervals of less than about 10 milliseconds.

6. The borehole imaging tool of claim 1, wherein each of the data pairs comprises a logging while drilling data point and a tool face angle measured at substantially the same instant in time.

7. The borehole imaging tool of claim 1, further comprising:

an internal pressure housing deployed substantially coaxially in the tool body, the conductive tube deployed in the internal pressure housing; and an annular region between an inner surface of the tool body and an outer surface of the pressure housing, the annular region disposed to receive a flow of drilling fluid through the tool.

8. A borehole imaging tool comprising:

a tool body configured for rotating with a drill string in a subterranean borehole;

at least one magnetoresistive magnetic field sensor deployed in the tool body, the at least one magnetoresistive magnetic field sensor disposed to measure first and second cross axial components of a magnetic field in the subterranean borehole;

an electrical transmission path for conducting electrical power from one longitudinal end of the tool to another longitudinal end thereof, the transmission path including an electrically conductive, non-magnetic tube, the conductive tube deployed in the tool body, the magnetoresistive magnetic field sensor deployed in the conductive tube;

at least one logging while drilling sensor deployed in the tool body, the at least one logging while drilling sensor disposed to make formation property measurements in the subterranean borehole; and a programmed processor communicatively coupled with the at least one magnetoresistive magnetic field sensor and the at least one logging while drilling sensor, the programmed processor configured to calculate tool face angles of the at least one logging while drilling sensor in substantially real time from the cross axial components of the magnetic field.

9. The borehole imaging tool of claim 8, wherein the programmed processor is configured to both calculate the tool face angles and correlate the tool face angles with logging while drilling formation property measurements at intervals of less than about 10 milliseconds.

10. The borehole imaging tool of claim 8, wherein the at least one logging while drilling sensor is selected from the group consisting of a natural gamma ray sensor, a neutron sensor, a density sensor, a resistivity sensor, a formation pressure sensor, an annular pressure sensor, an ultrasonic sensor, and an audio-frequency acoustic sensor.

11. The borehole imaging tool of claim 8, wherein the at least one magnetoresistive magnetic field sensor is selected from the group consisting of giant magnetoresistive sensors and anisotropic magnetoresistive sensors.

12. The borehole imaging tool of claim 8, wherein the at least one magnetoresistive magnetic field sensor comprises a tri-axial arrangement of magnetoresistive magnetic field sensors, one of the tri-axial arrangement of magnetoresistive magnetic field sensors being substantially aligned with a longitudinal axis of the tool body.

13. The borehole imaging tool of claim 8, further comprising a tri-axial arrangement of gravity sensors.

14. The borehole imaging tool of claim 8, wherein the programmed processor correlates the logging while drilling formation property measurements and the tool face angles into a set of corresponding data pairs measured at substantially the same instant in time.

15. The borehole imaging tool of claim 8, further comprising:

an internal pressure housing deployed substantially coaxially in the tool body, the conductive tube deployed in the internal pressure housing; and an annular region between an inner surface of the tool body and an outer surface of the pressure housing, the annular region disposed to receive a flow of drilling fluid through the tool.

16. A downhole measurement tool comprising:

a tool body configured to be operatively coupled with a drill string and deployed in a subterranean borehole;

an electrical transmission path for conducting electrical power from one longitudinal end of the tool to another longitudinal end thereof, the transmission path including an electrically conductive, non-magnetic tube, the conductive tube deployed in the tool body; and at least one magnetic field sensor deployed in the conductive tube.

17. The downhole measurement tool of claim 16, wherein the at least one magnetic field sensor comprises a tri-axial arrangement of magnetoresistive sensors, the tri-axial arrangement of magnetoresistive sensors disposed to measure tri-axial components of a magnetic field in the subterranean borehole.

18. The downhole measurement tool of claim 17, further comprising a programmed processor communicatively coupled with the tri-axial arrangement of magnetoresistive sensors, the programmed processor configured to calculate tool face angles in substantially real time from the tri-axial components of the magnetic field.

19. The downhole measurement tool of claim 18, wherein the programmed processor is configured to calculate the tool face angles at intervals of less than about 10 milliseconds.

20. The downhole measurement tool of claim 16, wherein the conductive tube is deployed substantially coaxially with the tool body.

21. The downhole measurement tool of claim 16, further comprising:

an internal pressure housing deployed in the tool body, the conductive tube deployed in the internal pressure housing; and an annular region between an inner surface of the tool body and an outer surface of the pressure housing, the annular region disposed to receive a flow of drilling fluid through the tool.

22. The downhole measurement tool of claim 16, wherein the conductive tube is fabricated from a material selected from the group consisting of copper, copper alloys, aluminum, and aluminum alloys.

23. The downhole measurement tool of claim 16, further comprising a tri-axial arrangement of gravity sensors.

24. A downhole measurement tool comprising:

a tool body configured for rotating with a drill string in a subterranean borehole;

an electrical transmission path for conducting electrical power from one longitudinal end of the tool to another longitudinal end thereof, the transmission path including an electrically conductive, non-magnetic tube, the conductive tube deployed in the tool body;

at least one magnetic field sensor deployed in the conductive tube, the sensor disposed to measure first and second cross axial components of a magnetic field in the subterranean borehole; and a programmed processor communicatively coupled with the at least one magnetic field sensor, the programmed processor configured to calculate tool face angles in substantially real time from the cross axial components of the magnetic field.

25. The downhole measurement tool of claim 24, further comprising:

a tri-axial arrangement of gravity sensors, the tri-axial arrangement of gravity sensors disposed to measure tri-axial components of a gravitational field in the subterranean borehole; and the programmed processor further communicatively coupled with the tri-axial arrangement of gravity sensors, the programmed processor further configured to calculate the tool face angles from the cross axial components of the magnetic field and the tri-axial components of the gravitational field.

26. The downhole measurement tool of claim 24, further comprising:

an internal pressure housing deployed in the tool body, the conductive tube deployed in the internal pressure housing; and an annular region between an inner surface of the tool body and an outer surface of the pressure housing, the annular region disposed to receive a flow of drilling fluid through the tool.

27. The downhole measurement tool of claim 24, wherein the conductive tube is fabricated from a material selected from the group consisting of copper, copper alloys, aluminum, and aluminum alloys.

28. A string of downhole tools comprising:

an electrical power sub;

a logging while drilling tool including at least one logging while drilling sensor, the at least one logging while drilling sensor disposed to make formation property measurements in a subterranean borehole; and a borehole imaging tool deployed between the electric power sub and the logging while drilling tool, the borehole imaging tool including:

a tool body;

an electrical transmission path for conducting electrical power from the electrical power sub to the logging while drilling tool, the transmission path including an electrically conductive, non-magnetic tube, the conductive tube deployed in the tool body;

at least one magnetic field sensor deployed in the conductive tube, the magnetic field sensor disposed to measure first and second cross axial components of a magnetic field adjacent a subterranean borehole; and a programmed processor communicatively coupled with the at least one magnetic field sensor, the programmed processor configured to calculate tool face angles of the at least one logging while drilling sensor in substantially real time from the cross axial components of the magnetic field and correlate the logging while drilling formation property measurements and the tool face angles into a set of corresponding data pairs.

29. The string of downhole tools of claim 28, wherein the electrical power sub comprises at least one member of the group consisting of a battery and a turbine.

30. The string of downhole tools of claim 28, wherein the borehole imaging tool further comprises:

a tri-axial arrangement of gravity sensors, the tri-axial arrangement of gravity sensors disposed to measure tri-axial components of a gravitational field in the subterranean borehole; and the programmed processor further communicatively coupled with the tri-axial arrangement of gravity sensors, the programmed processor further configured to calculate the tool face angles from the cross axial components of the magnetic field and the tri-axial components of the gravitational field.

31. The string of downhole tools of claim 28, wherein the measurement tool further comprises:

an internal pressure housing deployed in the tool body, the conductive tube deployed in the internal pressure housing; and an annular region between an inner surface of the tool body and an outer surface of the pressure housing, the annular region disposed to receive a flow of drilling fluid through the string of tools.

32. The string of downhole tools of claim 28, wherein the conductive tube is fabricated from a material selected from the group consisting of copper, copper alloys, aluminum, and aluminum alloys.

* * * * *